US007500505B2

(12) United States Patent
Smith et al.

(10) Patent No.: US 7,500,505 B2
(45) Date of Patent: Mar. 10, 2009

(54) ROLLER STOP FOR COVERINGS FOR ARCHITECTURAL OPENINGS

(75) Inventors: Stephen P. Smith, Denver, CO (US); Brian M. Hoffmann, Louisville, CO (US)

(73) Assignee: Hunter Douglas Inc., Upper Saddle River, NJ (US)

( * ) Notice: Subject to any disclaimer, the term of this patent is extended or adjusted under 35 U.S.C. 154(b) by 217 days.

(21) Appl. No.: 11/537,079

(22) Filed: Sep. 29, 2006

(65) Prior Publication Data

US 2007/0079943 A1 Apr. 12, 2007

Related U.S. Application Data

(60) Provisional application No. 60/725,026, filed on Oct. 7, 2005.

(51) Int. Cl.
*E06B 9/08* (2006.01)

(52) U.S. Cl. ..... 160/120; 160/84.05

(58) Field of Classification Search ..... 160/121.1, 160/84.05, 291, 293.1
See application file for complete search history.

(56) References Cited

U.S. PATENT DOCUMENTS 588,848 A * 8/1897 Wightman ..... 24/30.5 R
4,881,707 A * 11/1989 Garfinkle ..... 248/222.12
5,131,616 A * 7/1992 Biba ..... 248/265
5,383,739 A * 1/1995 Haglund ..... 403/107
5,611,111 A * 3/1997 Bosgoed ..... 16/93 D
5,697,589 A * 12/1997 Garfinkle ..... 248/223.41
5,918,842 A * 7/1999 Garfinkle ..... 248/223.41
6,027,091 A * 2/2000 Johnson ..... 248/340
6,299,115 B1 * 10/2001 Kovach et al. ..... 248/262
6,311,432 B1 * 11/2001 Watson ..... 49/383
6,688,368 B2 * 2/2004 Kovach et al. ..... 160/84.02
7,147,029 B2 * 12/2006 Kovach et al. ..... 160/121.1
7,240,715 B2 * 7/2007 Hoffmann ..... 160/120
7,341,091 B2 * 3/2008 Nien et al. ..... 160/170
2002/0027184 A1 * 3/2002 Kovach et al. ..... 248/262
2004/0118528 A1 * 6/2004 Kovach et al. ..... 160/168.1 P
2005/0139329 A1 * 6/2005 Hoffmann ..... 160/84.01
2006/0278346 A1 * 12/2006 Kovach et al. ..... 160/168.1 P
2006/0284585 A1 * 12/2006 Kovach et al. ..... 318/466

* cited by examiner

*Primary Examiner*—Katherine W Mitchell
*Assistant Examiner*—Jaime F Cardenas-Garcia
(74) *Attorney, Agent, or Firm*—Dorsey & Whitney LLP

(57) ABSTRACT

A roller stop for connection to the head rail of a covering for an architectural openings is releasably connectable to a rear edge of the head rail in overlying relationship with a roller having shade material thereon with the shade material having a bottom rail. The roller stop has a pivotally mounted body selectively positionable in closely adjacent but spaced relationship from the outer wrap of shade material on the roller and in a position to engage the bottom rail when the shade material is fully wrapped on said roller. A catch arm is selectively engageable with serrated teeth to releasable hold the pivotal body in a preselected desired position.

11 Claims, 5 Drawing Sheets

ROLLER STOP FOR COVERINGS FOR ARCHITECTURAL OPENINGS

CROSS-REFERENCE TO RELATED APPLICATION

The present application claims the benefit under 35 U.S.C. § 119(e) to U.S. Provisional Patent Application No. 60/725,026 ("the '026 application"), which was filed on Oct. 7, 2005 and entitled "Roller Stop For Coverings For Architectural Openings." The '026 application is incorporated by reference into the present application in its entirety.

BACKGROUND OF THE INVENTION

1. Field of the Invention

The present invention relates generally to coverings for architectural openings and more specifically to a roller stop adapted to limit the retracting rotation of a roller on which a shade material is mounted in an architectural opening.

2. Description of the Relevant Art

Generally, window coverings have various mechanical means for controlling the upper and lower positions of the fabric sheeting materials used in the covering. Such mechanical means is commonly referred to as a limit stop and when the sheeting material is mounted on a roller a "roller stop." The roller stop ensures that the fabric material of the window covering does not traverse into the head rail more than intended. By way of example, window shade products generally use a ratchet and pawl device to stop the fabric from winding too far into the upper portion of the window. In another example, a ball stop may be attached to the operating cord to prevent the cord from traveling into the operating system beyond its design, thus preventing the fabric from wedging into the head rail. In yet another example, a bottom rail may be provided with extensions to its width to prevent it from entering the head rail. Regardless of the type of covering, it is beneficial to the operation of the window covering that some type of stop is installed in the system for the typical window covering to operate easily and efficiently regardless of whether it is an upper or lower stop.

In one roller stop known in the trade, first and second pivotally connected elements are utilized wherein the first element is attached to the rear edge of the head rail and the second element is pivotally connected to the first element so as to ride along the shade material wrapped about a roller. Such a roller stop has not been without problems inasmuch as the hinge connection of the two elements has an objectionable noise factor and the constant contact of the second element with the shade material, as well as the repetitive raising and lowering of the shade, causes soiling of the fabric where the limit stop contacts the fabric.

A roller stop designed to overcome the aforenoted issues is disclosed in pending U.S. application Ser. No. 11/021,921 (U.S. publication No. 2005/0139329 A1) entitled "Limit Stop for Coverings for Architectural Openings" which is of common ownership with the present application. The roller stop disclosed in this application has pivotal components and a fairly complex locking system so that one component can be disposed closely adjacent to but spaced from the shade material so as not to soil the fabric.

It is to provide an improvement in roller stops and to avoid the shortcomings of prior art roller stops that the present invention has been developed.

SUMMARY OF THE INVENTION

The roller stop of the present invention comprises a main body and a secondary body that are made of a substantially rigid material, but wherein the secondary body is pivotal relative to the main body. One of the main and secondary bodies includes a plurality of vertically disposed serrated teeth while the other of the main body and secondary body has a catch adapted to be selectively engaged between individual ones of the serrated teeth. The selected engagement of the catch with the serrated teeth determines the angular relationship of the main body relative to the secondary body thereby positively, but selectively positioning an abutment edge of the secondary body in closely adjacent but spaced relationship from the fabric when the fabric is fully wrapped on the roller for the covering. The abutment edge is adapted to engage a bottom rail connected to the lower edge of the fabric when the fabric is fully wrapped on the roller so as to prevent further rotation of the roller.

Other aspects, features and details of the present invention can be more completely understood by reference to the following detailed description of a preferred embodiment, taken in conjunction with the drawings and from the appended claims.

DETAILED DESCRIPTION OF THE PREFERRED EMBODIMENT

Figure 1:
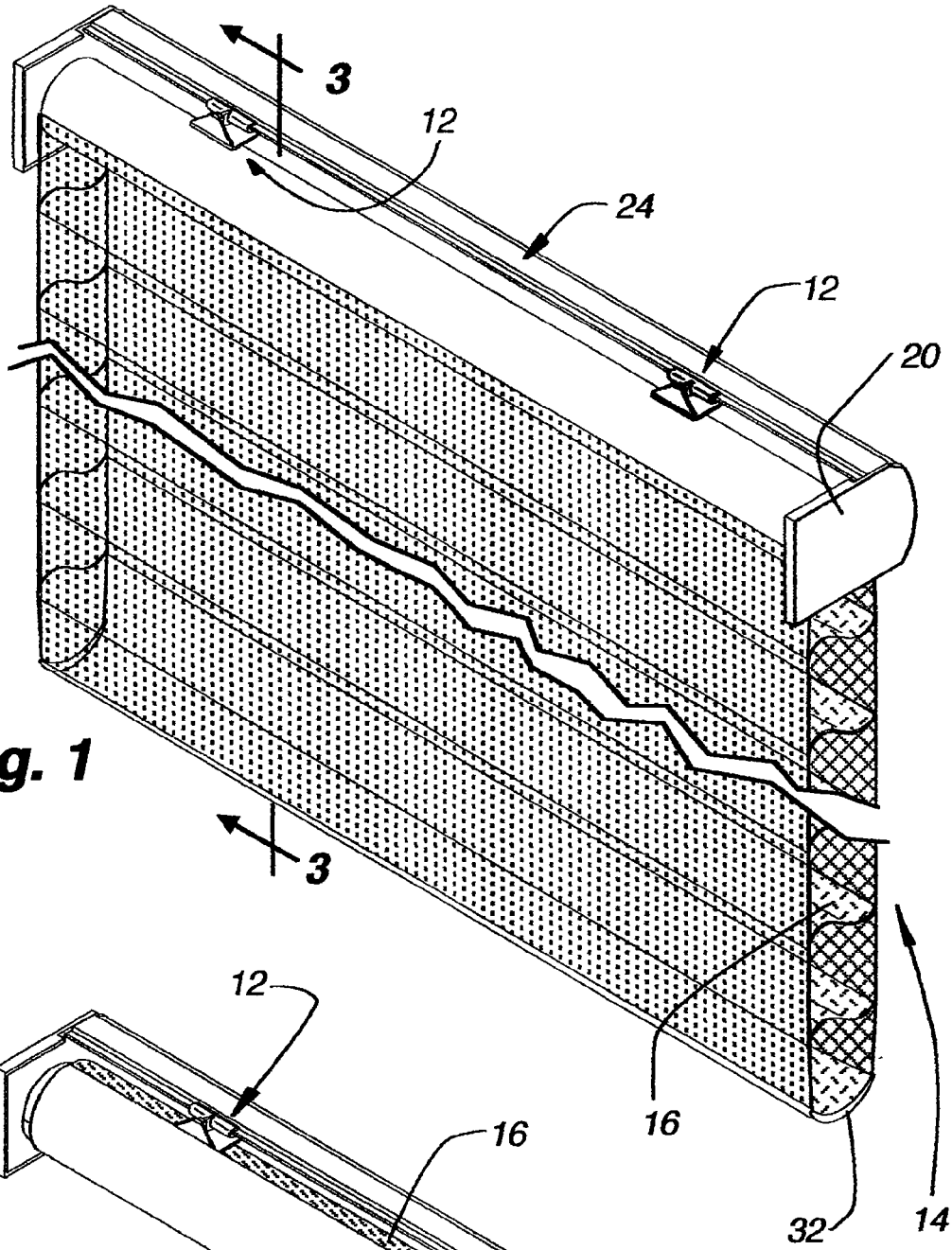
FIG. 1 is an isometric with parts removed of a covering for an architectural opening having a head rail with a roller rotatively mounted therein and a shade material suspended from the roller and shown in an extended position with the roller stops of the present invention being secured to the head rail.
Figure 2:
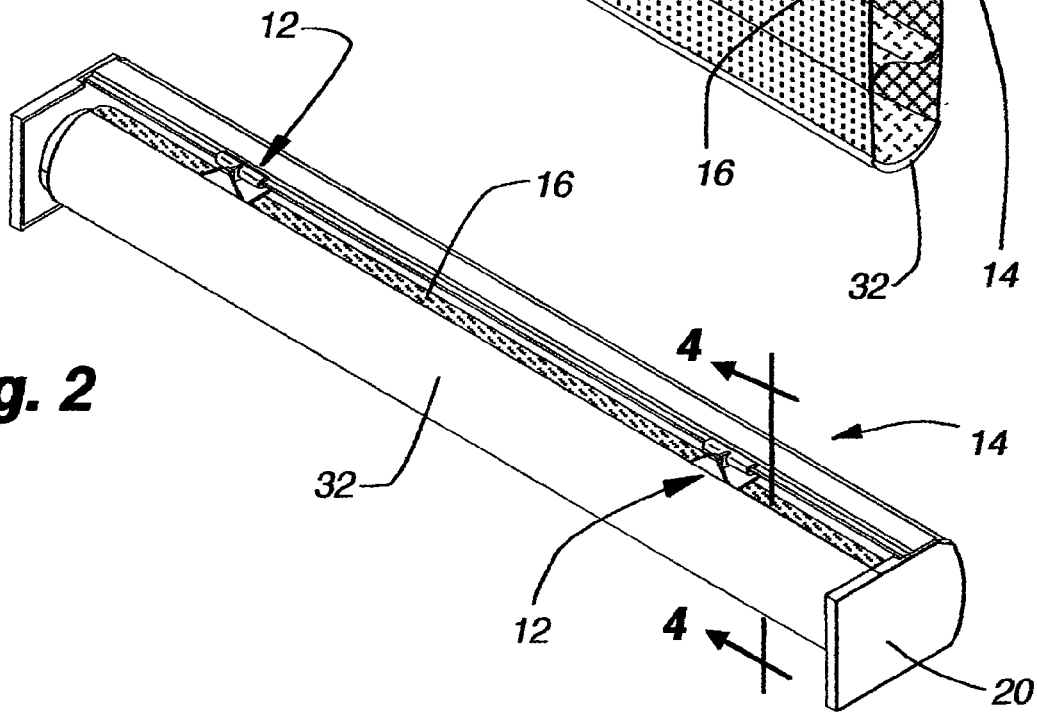
FIG. 2 is an isometric similar to FIG. 1 with the shade material in a fully retracted position.
Figure 3:
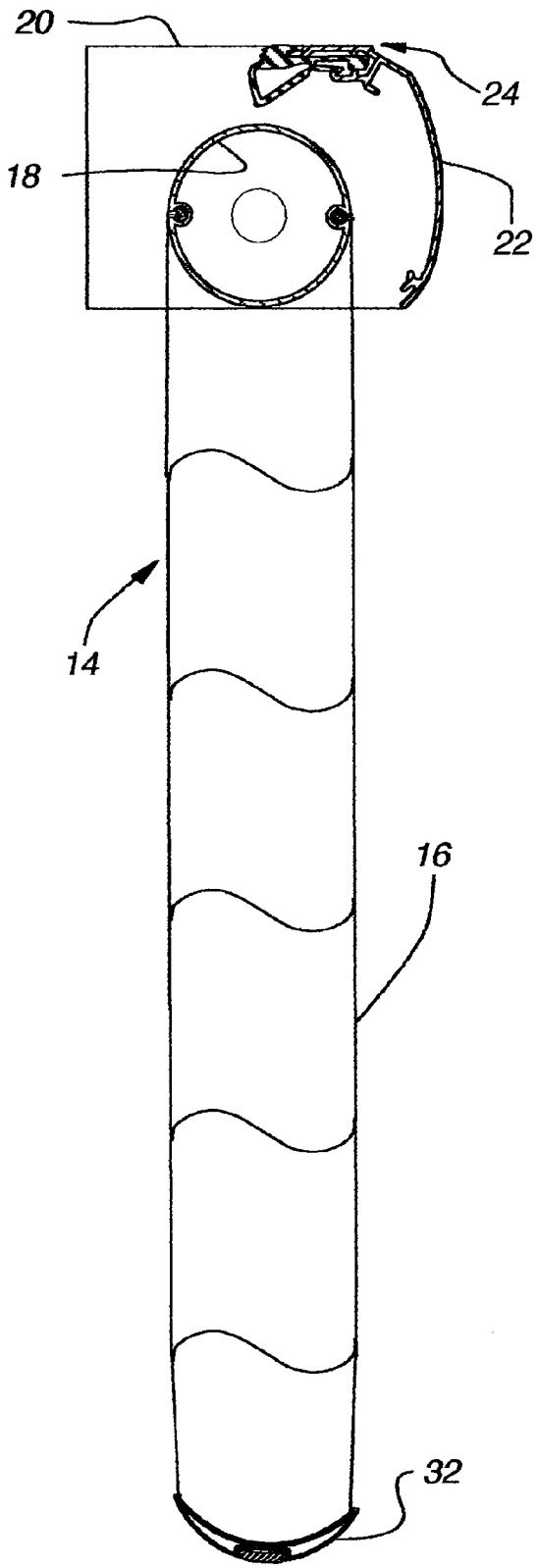
FIG. 3 is an enlarged section taken along line 3-3 of FIG. 1.
Figure 3A:
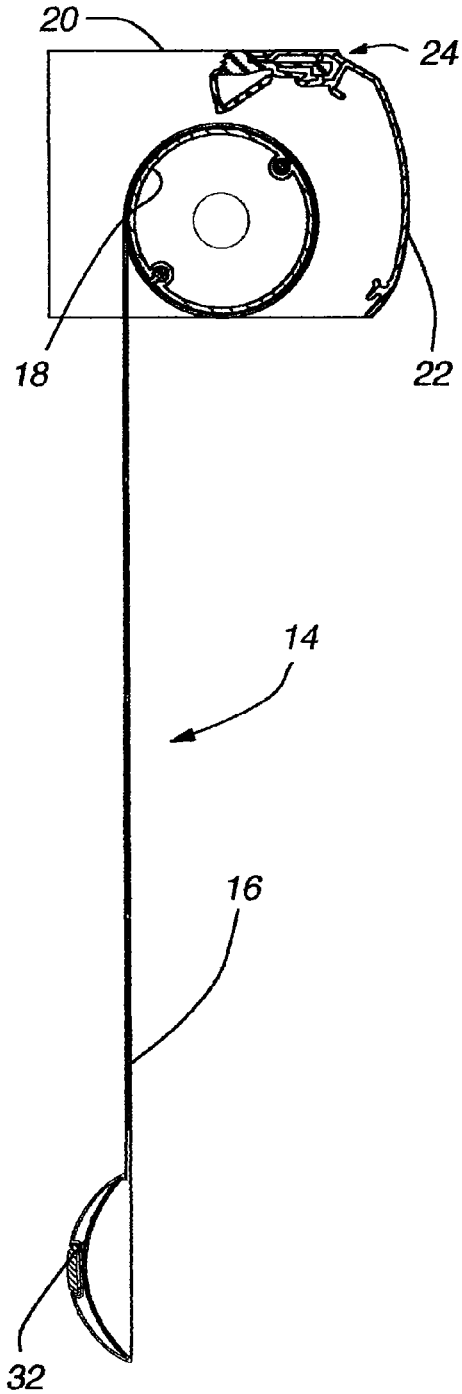
FIG. 3A is a section similar to FIG. 3 with the shade partially retracted.

A pair of roller stops 12 in accordance with the present invention is seen in FIGS. 1 and 2 mounted on a conventional covering 14 for an architectural opening wherein the covering is a roll-up cellular shade including a shade material 16 and a roller 18 (FIGS. 3, 3A, 4 and 4A) on which the shade material can be wrapped or unwrapped in a retracted or extended position of the covering respectively. A conventional head rail 20 overlies the roller and shade material wrapped thereabout for aesthetic purposes and the head rail and roller are mounted on brackets not shown in as much as they are not pertinent to an understanding of the present invention. In fact, the shade material would not need to be a cellular shade material, but any shade material that is flexible and can be wrapped about a roller in a rollup shade. The head rail for the covering is important to an understanding of the present invention only in that the roller stops 12 are mountable on the head rail.

Figure 4:
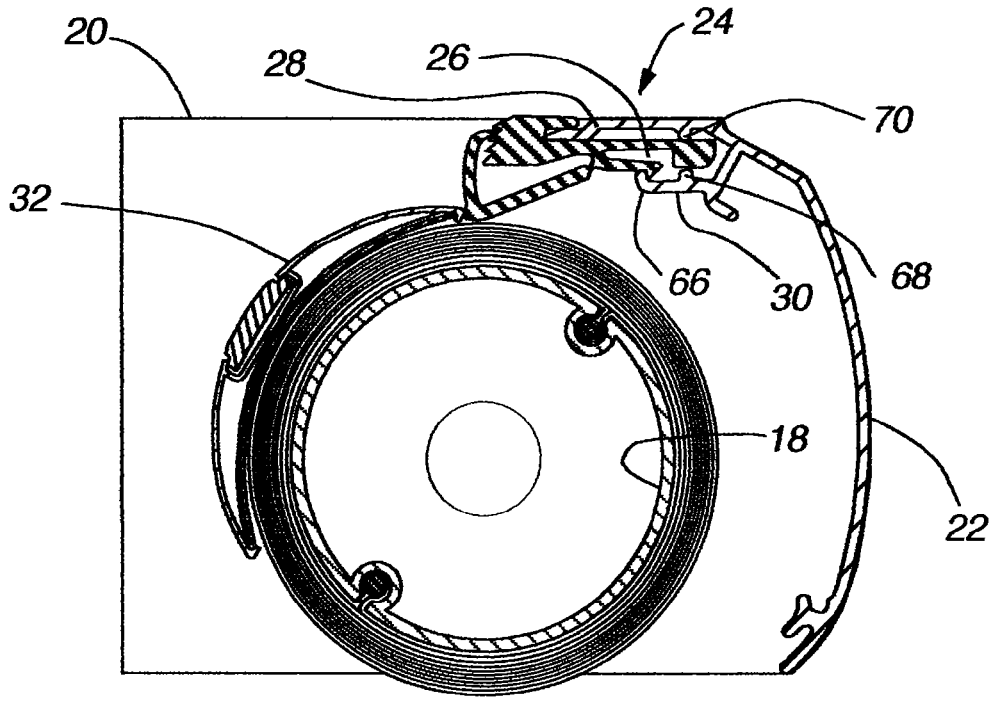
FIG. 4 is a section taken along line 4-4 of FIG. 2.
Figure 4A:
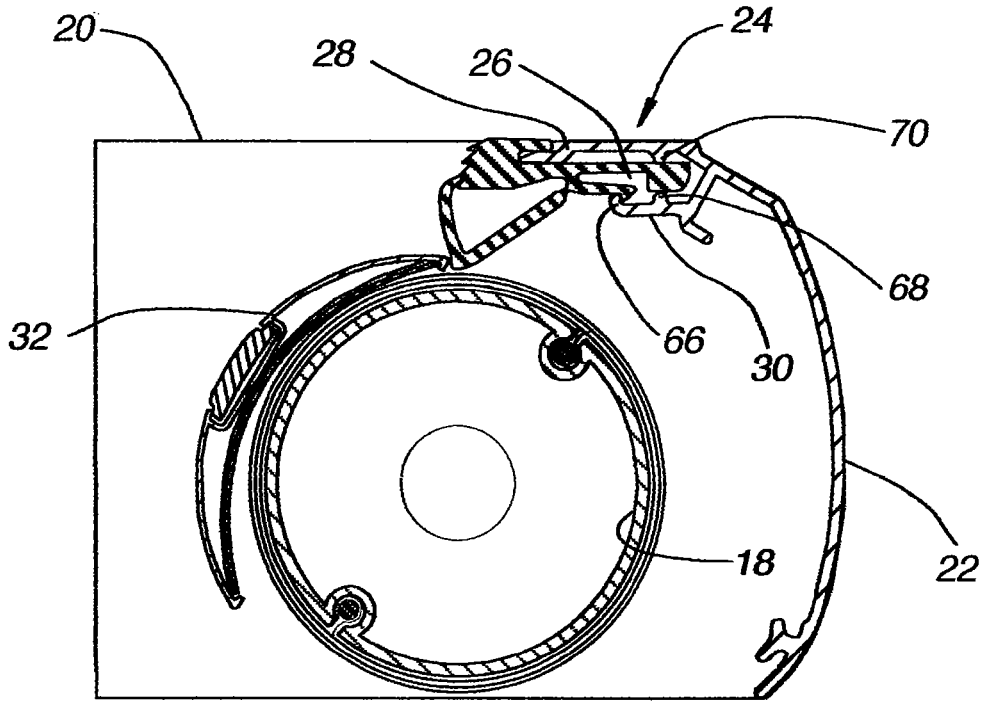
FIG. 4A is a section similar to FIG. 4 showing a shade material of a shorter length and thus a thinner wrap than that of FIG. 4.
Figure 5:
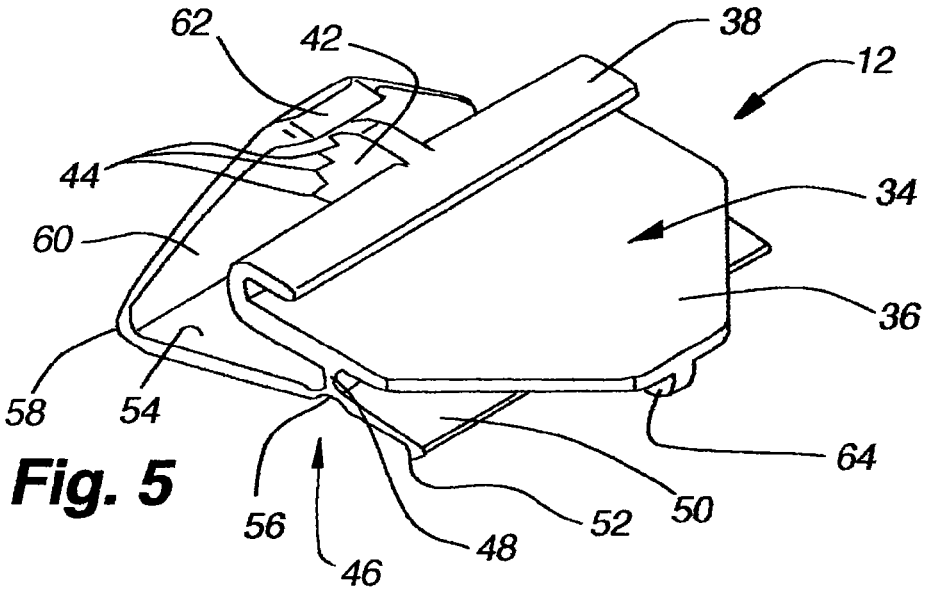
FIG. 5 is an isometric looking downwardly on the top of the roller stop of the invention.
Figure 6:
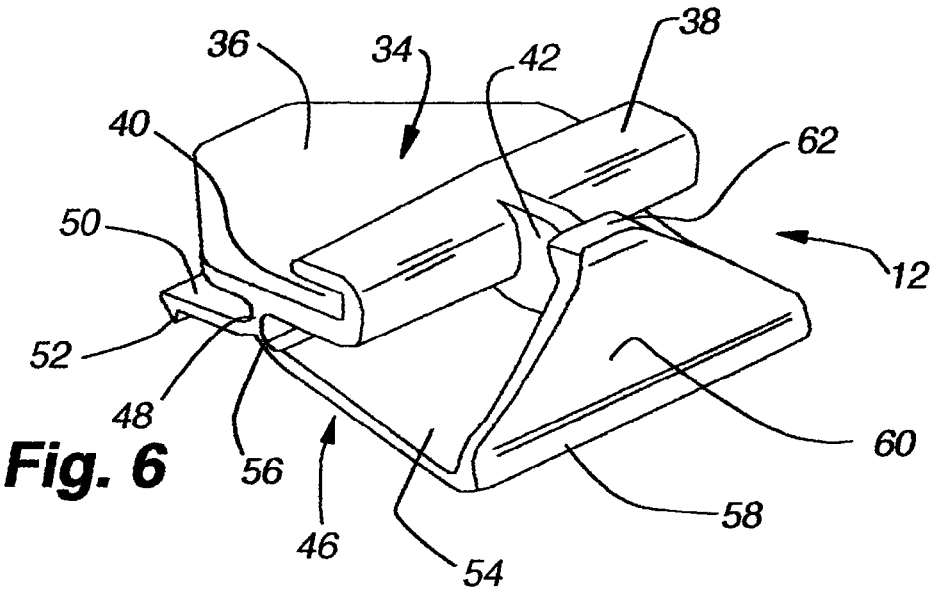
FIG. 6 is an isometric similar to FIG. 5 again looking downwardly on the top from a different direction.
Figure 7:
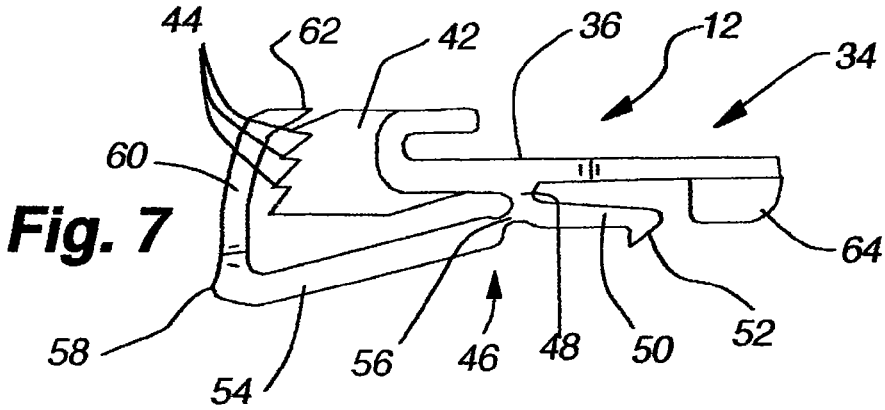
FIG. 7 is a side elevation of the roller stop as shown in FIG. 5.
Figure 8:
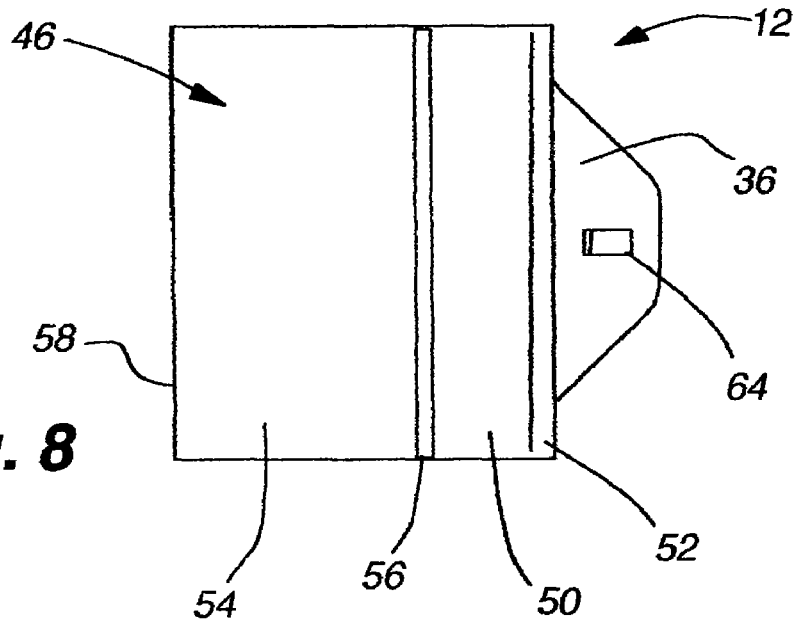
FIG. 8 is a bottom plan view of the roller stop.
Figure 9:
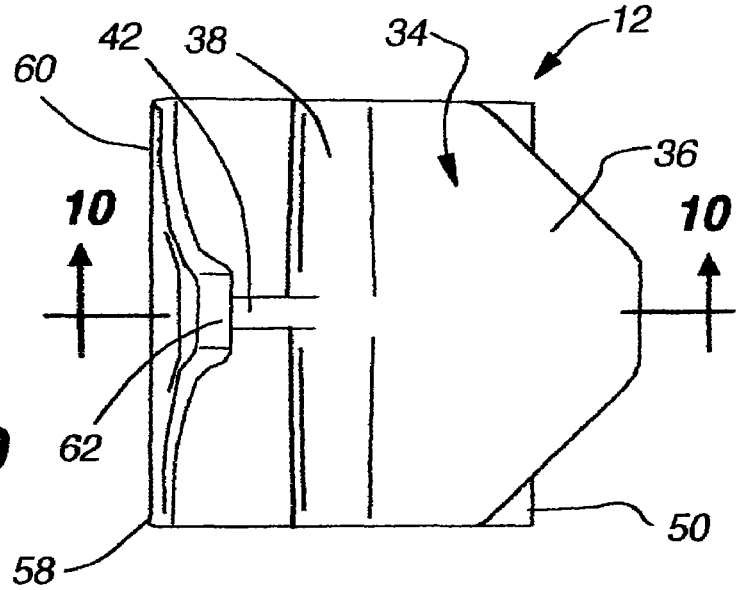
FIG. 9 is a top plan view of the roller stop.
Figure 10:
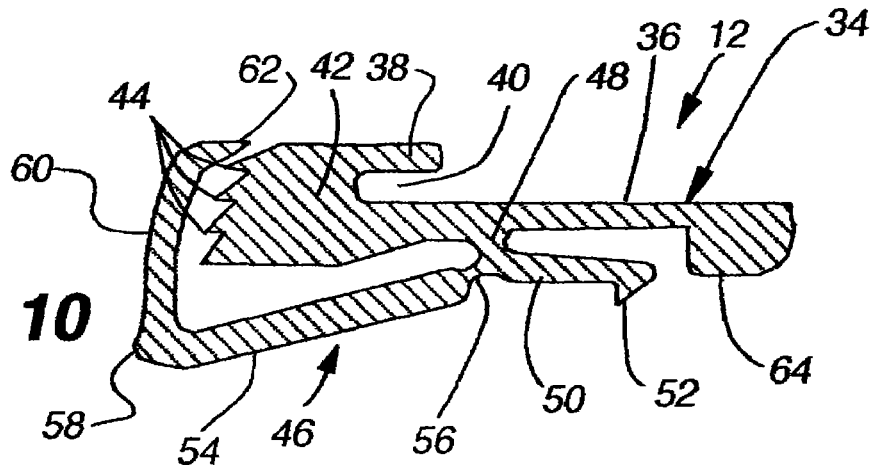
FIG. 10 is an enlarged section taken along line 10-10 of FIG. 9.

The head rail 20 as seen best in FIGS. 4 and 4A includes an arcuate main body 22 that depends downwardly from the front edge of an upper horizontal arm 24 with the arcuate main body lying in front of the roller 18 as viewed from the interior of a room in which the covering is mounted. The horizontal arm has a longitunally extending notch 26 formed in the back thereof defined by an upper ledge 28 and a lower ledge 30 with the upper ledge being slightly longer than the lower ledge so as to overlap the lower ledge along the rear edge of the head rail. The notch 26 in the rear edge of the head rail is adapted to cooperate with the roller stops 12 in releasably mounting the roller stops on the head rail as will be described in more detail hereafter.

The shade material 16 illustrated has a bottom rail 32 affixed to the bottom edge thereof which becomes tangentially related to the roller 18 when the shade material is wrapped circumferentially about the roller as best seen in FIGS. 4 and 4A.

The roller stop 12 is probably seen best in FIGS. 5-10 to include a main body 34 having a plate like component 36 of generally trapezoidal configuration and a raised reverse turned upper lip 38 defining a recess 40 therebetween. The rear edge of the plate like component, or the edge having the reverse turned upper lip, has a rearwardly projecting vertically oriented tab 42 with vertically spaced serrated teeth 44 along its rear edge.

A secondary body 46 of the roller stop is spaced beneath the main body 34 by a transverse web 48 of the main body with the secondary body having a forwardly projecting lower lip 50 spaced beneath in generally parallel relationship with the plate like component 36 of the main body. The forward most edge of the lower lip is beveled and defines a latch finger 52 for a purpose to be described hereafter. Projecting rearwardly from the transverse web 48 in generally co-planar relationship with the lower lip is a plate like component 54 of the secondary body which is connected to the transverse web of the main body with a pivot or hinge 56. An abutment edge 58 is defined at the rear edge of the plate like component 54 of the secondary body with the abutment edge being parallel to the pivot or hinge 56. A plate like catch arm 60 projects substantially perpendicularly upwardly from the plate like portion of the secondary body but in reality at an obtuse angle approaching 90°. The catch arm has a catch lip 62 projecting forwardly from its upper edge immediately adjacent to the serrated teeth 44 on the main body. The hinge 56 permits the plate like component 54 of the secondary body and the catch arm 60 to pivot in a vertical plane about the hinge 56 and relative to the main body 34 in a manner such that the catch lip 62 can be removably positioned between selected ones of the serrated teeth thereby establishing a predetermined angle between the plate like component of the secondary body and the plate like component of the main body. As will be appreciated, the abutment edge of the secondary body is thereby moveable upwardly or downwardly to adjust the vertical spacing between the abutment edge and the plate like component of the main body.

The plate like component 36 of the main body also has a downwardly projecting finger 64 that is transversely centered at the front edge of the plate like component, the function of which will be described hereafter.

The plate like component 36 of the main body and the forwardly projecting lower lip 50 of the secondary body as well as the forwardly projecting upper lip 38 of the main body are designed to cooperate with the upper 28 and lower 30 ledges of the head rail 20 to releasably connect the roller stop 12 to the head rail in a position for limiting rotation of the roller 18 when the covering is fully retracted. With reference to FIGS. 4 and 4A, the rear edge of the upper ledge 28 of the head rail is insertable into the recess 40 between the upper lip and the plate like component 36 of the main body as the main body is simultaneously inserted into the notch 26 between the upper and lower ledges of the head rail. The lower ledge has an upturned lip 66 along its rear edge adapted to cooperate with the latch finger 52 of the secondary body at a location rearwardly spaced from a raised bead 68 on the lower ledge. The raised bead on the lower ledge is vertically aligned with a depending bead 70 from the upper ledge such that the downwardly projecting finger 64 at the front edge of the main body can be pinched and thereby captured between the upper and lower beads. When the roller stop 12 is fully inserted into the notch, the downwardly projecting finger 64 is positioned between the upper and lower beads and the latch finger has been flexed so as to snap over the upturned lip 66 on the lower ledge.

It will be seen the roller stop 12 is positively but releasably connected to the head rail 20 and can be positioned at any location along the length of the head rail. Any number of roller stops can be utilized depending upon the width of the covering on which the roller stops are mounted, but in the illustrated embodiment, two of the roller stops are used and mounted at locations spaced inwardly from opposite ends of the head rail.

The roller stop 12 can be made of any suitable material, but in the preferred embodiment, the roller stop is made of a somewhat rigid plastic material having some flexibility depending upon the thickness of the material. In other words, at the locations where it is desired that the plastic material be more rigid, it is made relatively thick, but where it is desired to flex it is made relatively thin.

The pivot or hinge 56 is defined by a relatively thin segment of the roller stop 12 so that the relatively thin material at the pivot defines a living hinge permitting the plate like component 54 of the secondary body to pivot about the living hinge. Of course, pivotal movement of the plate like component of the secondary body permits the catch lip 62 to be positioned between any desirable pair of serrated teeth 44 so the plate like component of the secondary body is selectively retained at an angle relative to the main body which positions the abutment edge 58 of the secondary body at a desired vertical spacing from the main body.

The desired positioning of the plate like component 54 of the secondary body is determined by the thickness of the wrap of shade material 16 on the roller which of course is determined by the length or vertical extent of the shade material when extended as shown in FIG. 1. When the shade material is wrapped about the roller 18 into the fully retracted position shown in FIGS. 4 and 4A, the bottom rail 32 of the shade material is shown engaged with the abutment edge 58 of the roller stop. The abutment edge is thus positioned through the interaction of the catch lip 62 with the serrated teeth 44 so that it is closely adjacent to but spaced from the shade material when the covering is fully retracted. The abutment edge is positioned, however, close enough to the shade material so as to engage the bottom rail and prevent further rotation of the roller. As viewed in FIGS. 4 and 4A, the roller is rotated in a clockwise direction when retracting the covering and in a counter clockwise direction when extending the covering. FIGS. 4 and 4A are illustrative of two different positions of the abutment edge of the secondary body to accommodate a relatively thick wrap (FIG. 4) or a relatively thin wrap (FIG. 4A).

As can be seen, the roller stop 12 can be easily removed from a head rail by simply pushing upwardly on the lower lip 50 of the secondary body to release the latch finger 52 from the upturned lip 66 and the angular positioning of the plate like component 54 of the secondary body is easily movable simply by flexing the catch arm 60 and repositioning the catch arm between a different selected pair of serrated teeth 40.

It will be appreciated from the above the roller stop of the present invention can be very inexpensively manufactured in a one piece construction and easily mounted on or removed from the head rail of a covering for architectural openings. It is further easily and dependably adjustable to accommodate rolled fabrics of different dimensions.

Although the present invention has been described with a certain degree of particularity, it is understood the present disclosure has been made by way of example, and changes in detail or structure may be made without the departing from the spirit of the invention as defined in the appended claims.

The invention claimed is:

1. A system for limiting retracting movement of a roller in a covering for an architectural opening comprising in combination: a head rail; a roller mounted in said head rail for reversible rotating movement between extended and retracted positions, said roller having a flexible shade material mounted thereon so as to be wrappable about said roller in said retracted position and unwrapped from said roller in said extended position, said shade material having a first edge connected to said roller and a second opposite free edge having a bottom rail thereon, and a unitary adjustable stop, said stop having a main body connected to said head rail and a secondary body pivotally connected to said main body, said secondary body having an abutment portion variably spaceable from said main body and being positionable adjacent to said shade material in said retracted position, said secondary body or said main body including serrated teeth and the other of said secondary body and main body including a catch finger for releasable engagement with individual ones of said serrated teeth to vary the spacing of said abutment portion from said main body.

2. A system for limiting retracting movement of a roller in a covering for an architectural opening comprising in combination: a head rail; a roller mounted in said head rail for reversible rotating movement between extended and retracted positions, said roller having a flexible shade material mounted thereon so as to be wrappable about said roller in said retracted position and unwrapped from said roller in said extended position, said shade material having a first edge connected to said roller and a second opposite free edge having a bottom rail thereon, and an adjustable stop, said stop having a main body connected to said head rail and a secondary body pivotally connected to said main body, said secondary body having an abutment portion variably spaceable from said main body while remaining spaced from said shade material, said secondary body or said main body including serrated teeth and the other of said secondary body and main body including a catch finger for releasable engagement with individual ones of said serrated teeth to vary the spacing of said abutment portion from said main body.

3. A system for limiting retracting movement of a roller in a covering for an architectural opening comprising in combination: a head rail; a roller mounted in said head rail for reversible rotating movement between extended and retracted positions, said roller having a flexible shade material mounted thereon so as to be wrappable about said roller in said retracted position and unwrapped from said roller in said extended position, said shade material having a first edge connected to said roller and a second opposite free edge having a bottom rail thereon, and an adjustable stop, said stop having a main body connected to said head rail and a secondary body flexibly connected to said main body, said secondary body having an abutment portion variably positionable in a plurality of releasably fixed positions so as to be selectively spaced from said main body and being positionable adjacent to said shade material in said retracted position, said secondary body or said main body including serrated teeth and the other of said secondary body and main body including a catch finger for releasable engagement with individual ones of said serrated teeth to vary the spacing of said abutment portion from said main body such that said abutment portion will engage and terminate rotating movement of said roller in said retracted position.

4. The system of claim 1, 2 or 3 wherein said stop is made of a substantially rigid material.

5. The system of claim 4 wherein said secondary body is flexibly connected to said main body with a living hinge.

6. The system of claim 1, 2 or 3 wherein said serrated teeth are disposed vertically.

7. The system of claim 1, 2 or 3 wherein said main body includes a plate like component disposed horizontally on said head rail, said secondary body includes a plate like component, and said flexible connection establishes a horizontal pivot axis permitting said plate like component of the secondary body to pivot in a vertical plane.

8. The system of claim 7 wherein said serrated teeth are in a vertical orientation such that said catch finger is positionable between selected ones of said teeth upon pivotal movement of said plate-like component of said secondary body.

9. The system of claim 8 wherein said serrated teeth are on said main body and said catch finger is on said secondary body.

10. The system of claim 8 wherein said abutment portion constitutes a movable edge of said plate-like component of said secondary body opposite said pivot axis.

11. The system of claim 9 wherein said catch finger constitutes a substantially perpendicular projection from said plate-like component of said secondary body.

* * * * *